US007387519B2

(12) United States Patent
Sugiyama

(10) Patent No.: US 7,387,519 B2
(45) Date of Patent: Jun. 17, 2008

(54) DEVICE FOR PROTECTING ELECTRIC COMPONENT

(75) Inventor: Junichi Sugiyama, Kanagawa (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 63 days.

(21) Appl. No.: 10/591,874

(22) PCT Filed: Feb. 10, 2006

(86) PCT No.: PCT/JP2006/002784

§ 371 (c)(1),
(2), (4) Date: Sep. 7, 2006

(87) PCT Pub. No.: WO2006/088116

PCT Pub. Date: Aug. 24, 2006

(65) Prior Publication Data

US 2007/0149038 A1 Jun. 28, 2007

(30) Foreign Application Priority Data

Feb. 21, 2005 (JP) ..... 2005-043716

(51) Int. Cl.
*H01R 13/52* (2006.01)

(52) U.S. Cl. ..... 439/135; 439/147; 439/521; 439/829; 174/138 F

(58) Field of Classification Search ..... 439/135, 439/147, 521, 892, 589; 174/138 F
See application file for complete search history.

(56) References Cited

U.S. PATENT DOCUMENTS

| | | | | |
|---|---|---|---|---|
| 6,739,906 | B2 * | 5/2004 | Lawrence et al. | 439/521 |
| 7,163,411 | B2 * | 1/2007 | Kawashima et al. | 439/135 |
| 2004/0179966 | A1 | 9/2004 | Kawashima et al. | |

FOREIGN PATENT DOCUMENTS

| | | |
|---|---|---|
| JP | 02-033478 | 2/1990 |
| JP | 10-318142 A | 12/1998 |

OTHER PUBLICATIONS

International Search Report for Application No. PCT/JP2006/302784, dated Jun. 21, 2006.

* cited by examiner

*Primary Examiner*—Gary F. Paumen
(74) *Attorney, Agent, or Firm*—RatnerPrestia

(57) ABSTRACT

A device for protecting an electric component for a compressor is provided, where the device is equipped with a bracket formed with an insert portion and a locking part having a locking hole, facing each other; and a cover formed with a clamp for clamping the distal end of the insert portion, and a ratchet fastened to the locking hole, and where the insert portion is formed of a plurality of projections with different length of projected portions in insert direction. This makeup enables only one ratchet to fix the cover securely to the bracket, as well as makes the cover to be resistant to fracture owing to a small distortion of the cover when detaching.

5 Claims, 7 Drawing Sheets

DEVICE FOR PROTECTING ELECTRIC COMPONENT

THIS APPLICATION IS A U.S. NATIONAL PHASE APPLICATION OF PCT INTERNATIONAL APPLICATION PCT/JP2006/302784.

TECHNICAL FIELD

The present invention relates to a device for protecting an electric component in a hermetic electromotive compressor used for a fridge-freezer apparatus and the like.

BACKGROUND ART

Some conventional devices for protecting an electric component (referred to as "protecting device" hereinafter) with this type can be fixed with a single inserting operation. Such a protecting device is disclosed in Japanese Patent Unexamined Publication No. H02-33478.

Hereinafter a description is made for the above-mentioned conventional protecting device with reference to FIGS. 7 and 8. FIG. 7 is an exploded perspective view of the above-mentioned device and FIG. 8 is an enlarged side view of the above-mentioned device in a state of being mounted.

In FIGS. 7 and 8, electromotive compressor unit 10 containing its electromotive compressing element (not illustrated) is mounted thereon with glass terminal 15 for supplying the above-mentioned electromotive compressing element with electricity. Glass terminal 15 is connected with electric components 19*a* and 19*b* for protecting or starting the above-mentioned electromotive compressing element.

Bracket 20, made of a bend formed iron plate, such as a cold-rolled or hot-rolled steel plate, is fastened to electromotive compressor unit 10 so as to enclose glass terminal 15. Bracket 20 is attached thereon with cover 50 for covering electric components 19*a* and 19*b*. Bracket 20 has locking holes 45 on the right and left sides bend formed, facing each other across glass terminal 15.

Cover 50 is formed from synthetic resin material such as polypropylene (PP) or polycarbonate (PC), injection molded. Cover 50 has tapered ratchet 70 for engaging locking hole 45, on the inner wall surface at a position corresponding to locking hole 45 provided on bracket 20.

Hereinafter, a description is made for the actions of the protecting device composed as described above.

Electric component 19 is inserted and fixed in glass terminal 15.

When inserting cover 50 for covering electric component 19 into bracket 20, the following actions occur as a result that tapered ratchets 70 touch the right and left sides of bracket 20 having locking holes 45. That is, the right and left wall surfaces provided thereon with ratchets 70 of cover 50 are distorted outward from the right and left sides of bracket 20; tapered ratchets 70 are fastened to locking holes 45 of bracket 20; and cover 50 is fixed to bracket 20 with a single operation.

In the above-mentioned conventional makeup, however, in order to detach cover 50 from bracket 20, the right and left wall surfaces provided thereon with ratchets 70 of cover 50 need to be respectively distorted outward from the right and left sides of bracket 20, to detach ratchets 70 from locking holes 45 of bracket 20. Consequently, cover 50 formed from synthetic resin material may be largely distorted, resulting in fracture.

DISCLOSURE OF THE INVENTION

The present invention provides a protecting device for a compressor, where the device is equipped with a bracket formed with an insert portion and a locking part having a locking hole, facing each other; and a cover formed with a clamp for clamping the distal end of the insert portion and a ratchet fastened to the locking hole, and the insert portion is formed of a plurality of projections with different length of projected portions in insert direction. Even in such a way, the entire flat surface of the insert portion is clamped when the cover is fixed to the bracket, thus suppressing the movement of the cover with the ratchet as the supporting point.

In order to detach the cover from the bracket, only one ratchet needs to be detached from the locking hole, which causes only the wall surface of the cover having the ratchet to be distorted. Consequently, this makeup allows providing a protecting device for a compressor, favorable in workability for attaching and detaching the cover, resistant to fracture, and highly reliable.

DETAILED DESCRIPTION OF PREFERRED EMBODIMENT

Hereinafter, a description is made for an exemplary embodiment of the present invention, with reference to the accompanying drawings. The drawings are schematic, and thus do not indicate each positional relationship with correct dimensions. This exemplary embodiment does not limit the present invention.

Exemplary Embodiment

Figure 1:
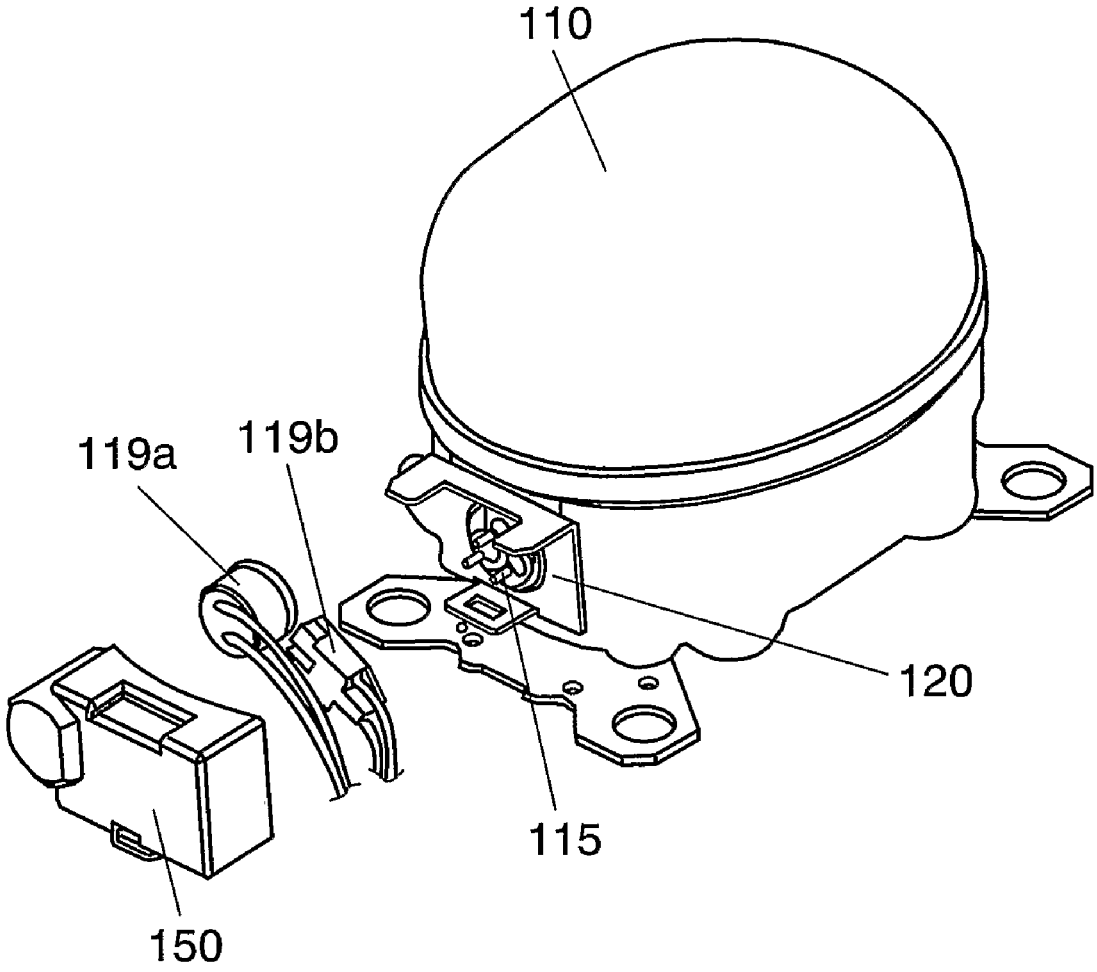
FIG. 1 is an exploded perspective view of a protecting device according to an exemplary embodiment of the present invention.
Figure 2:
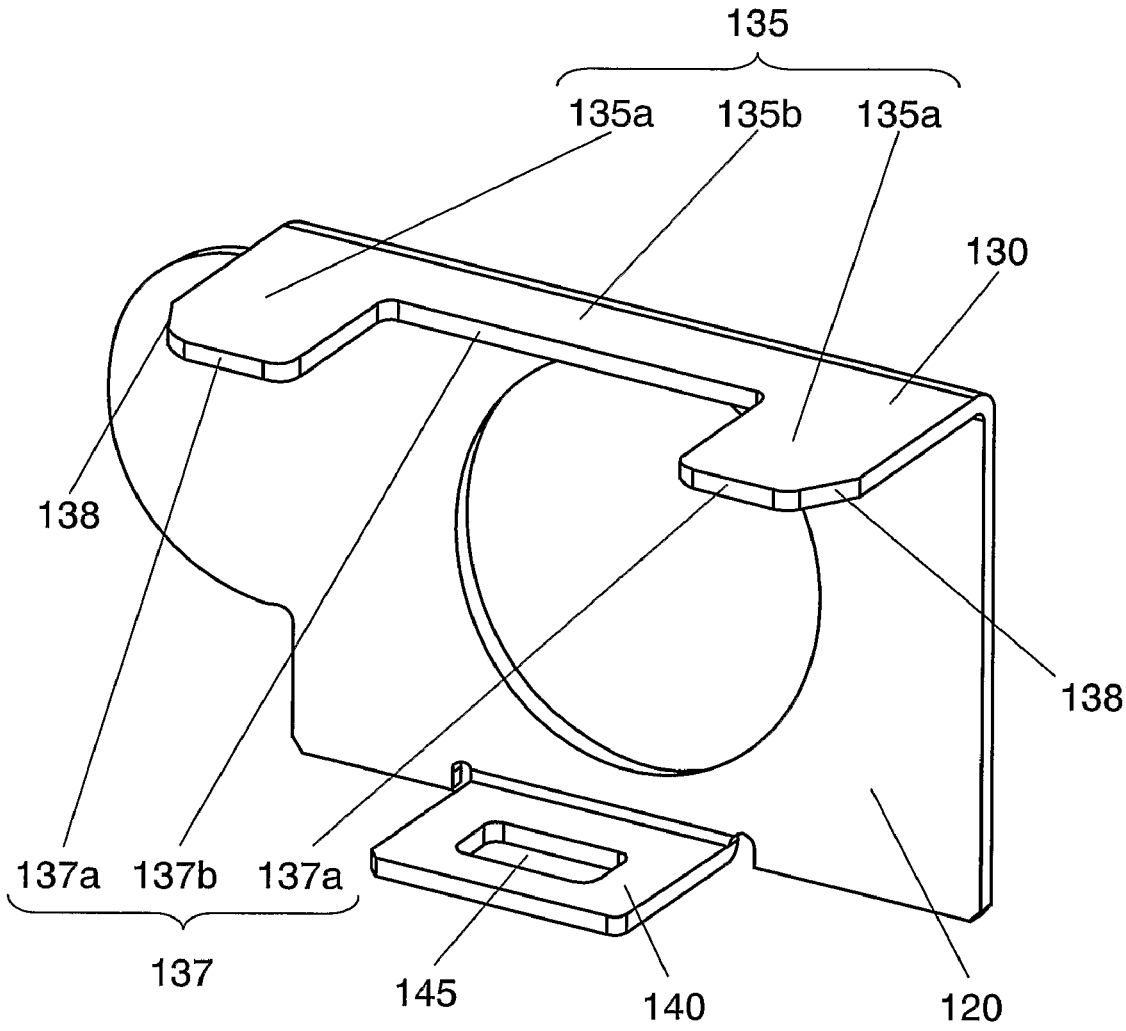
FIG. 2 is a perspective view of a bracket of the protecting device shown in FIG. 1.
Figure 3:
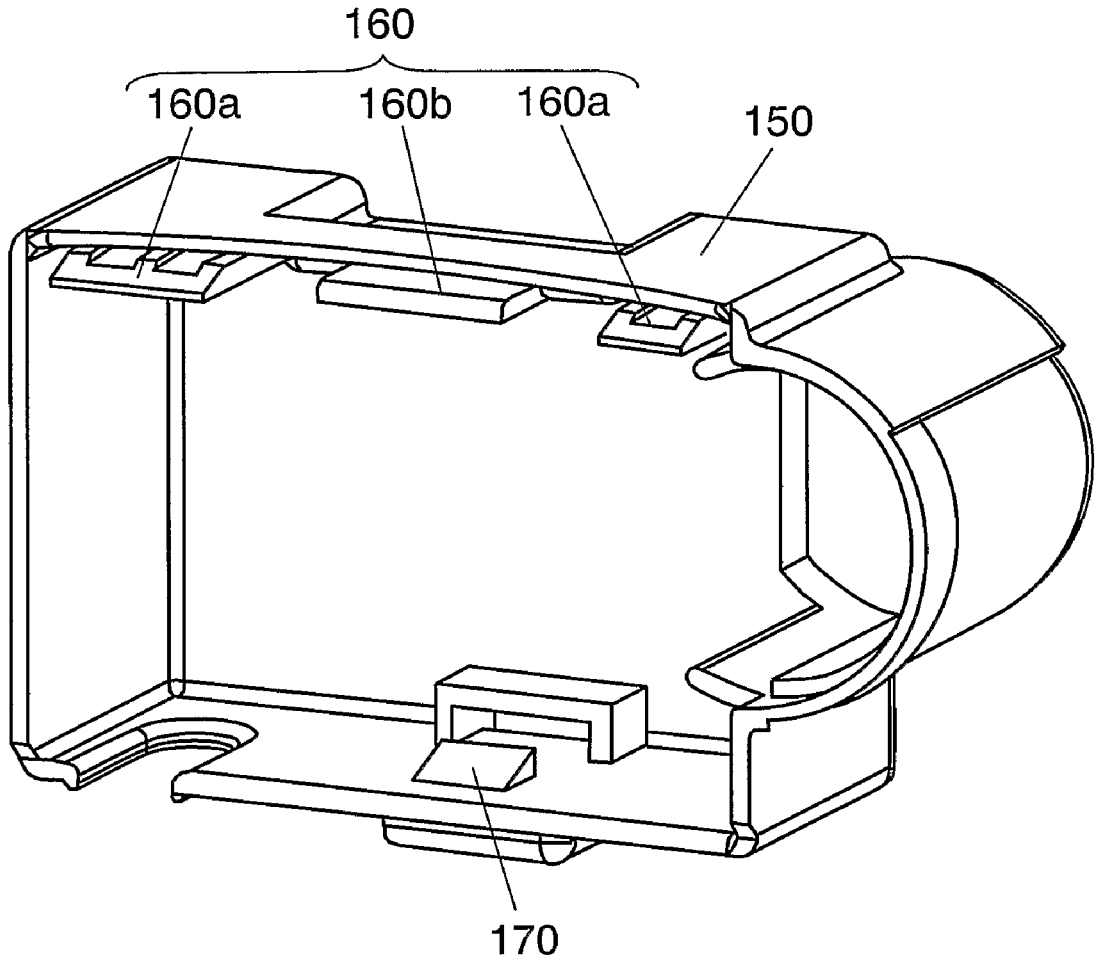
FIG. 3 is a perspective view of the cover shown in FIG. 1.
Figure 4:
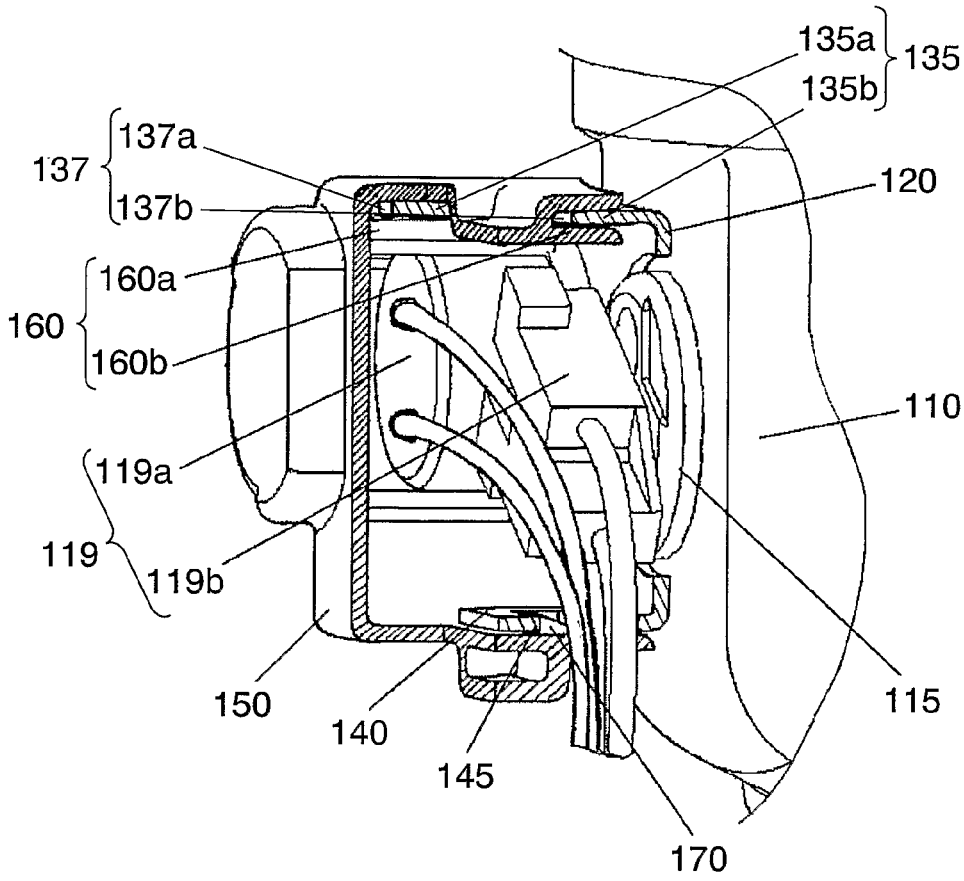
FIG. 4 is a sectional view of the substantial part of the protecting device shown in FIG. 1.
Figure 5:
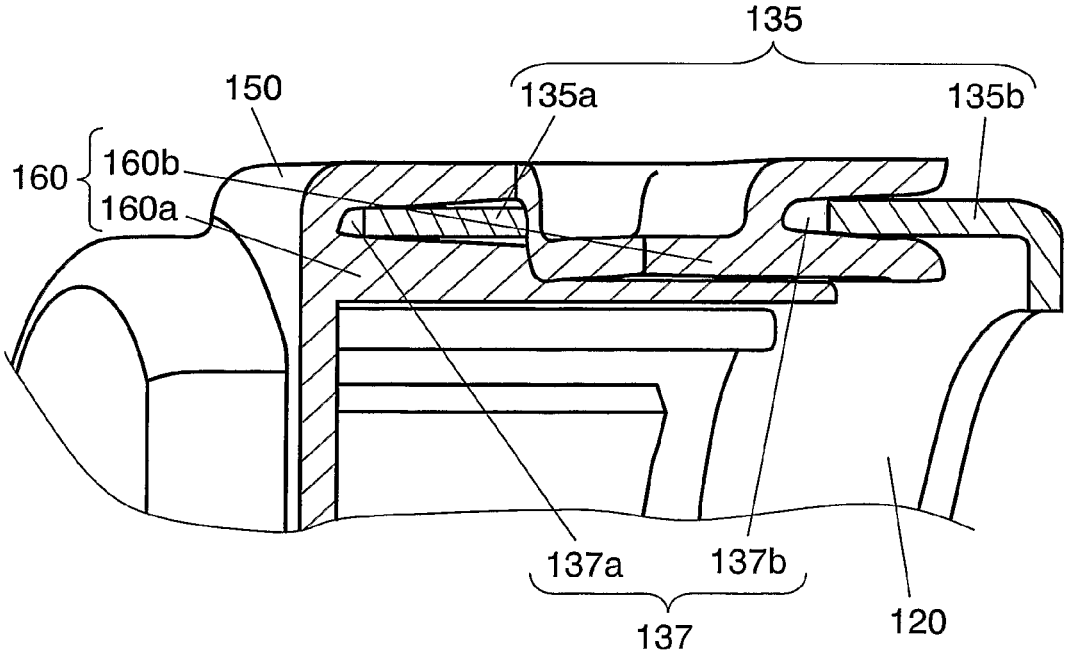
FIG. 5 is an enlarged sectional view of the protecting device shown in FIG. 1, in a state of being mounted.
Figure 6:
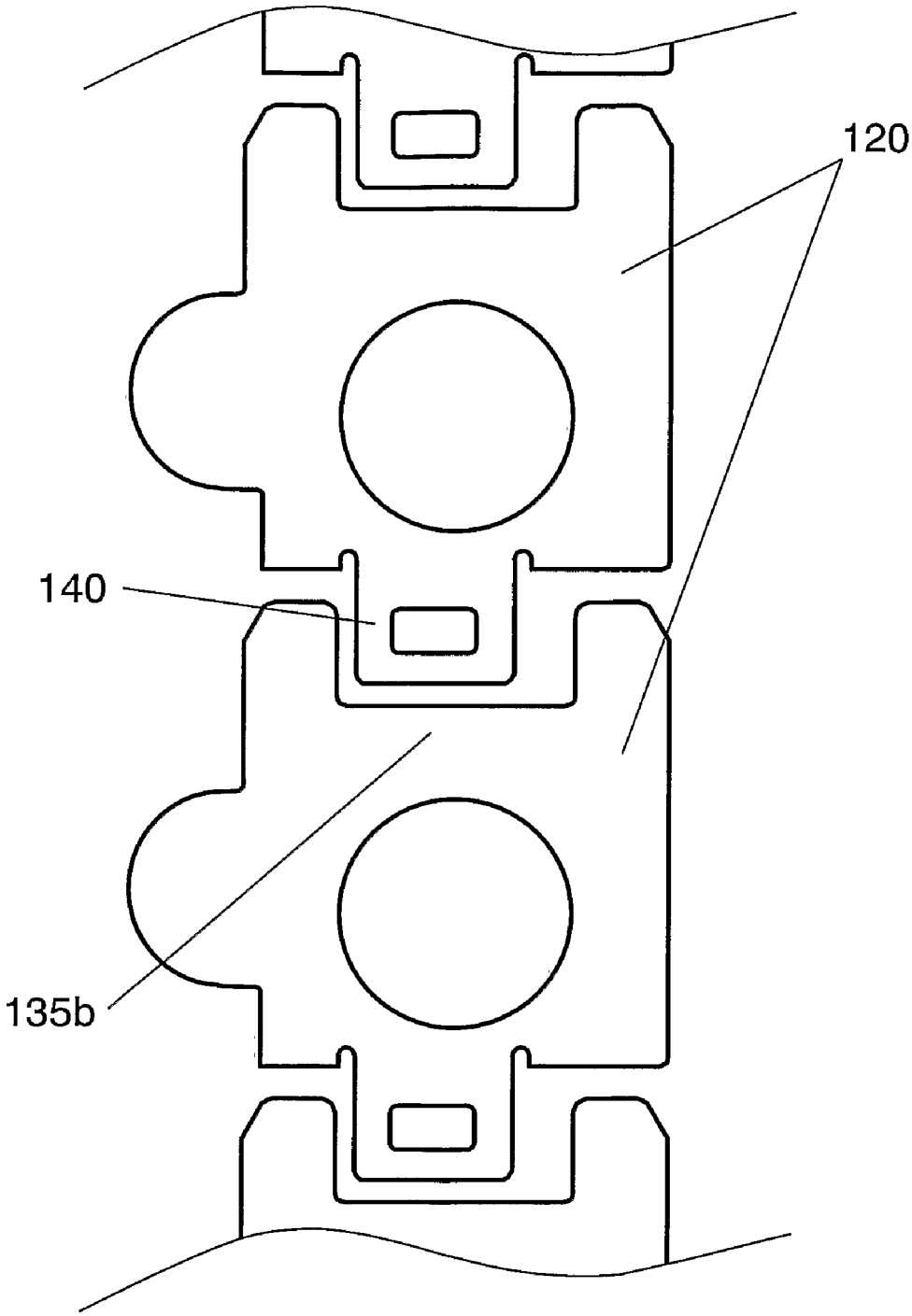
FIG. 6 is a developed view of the bracket shown in FIG. 1, in a progressive die.
Figure 7:
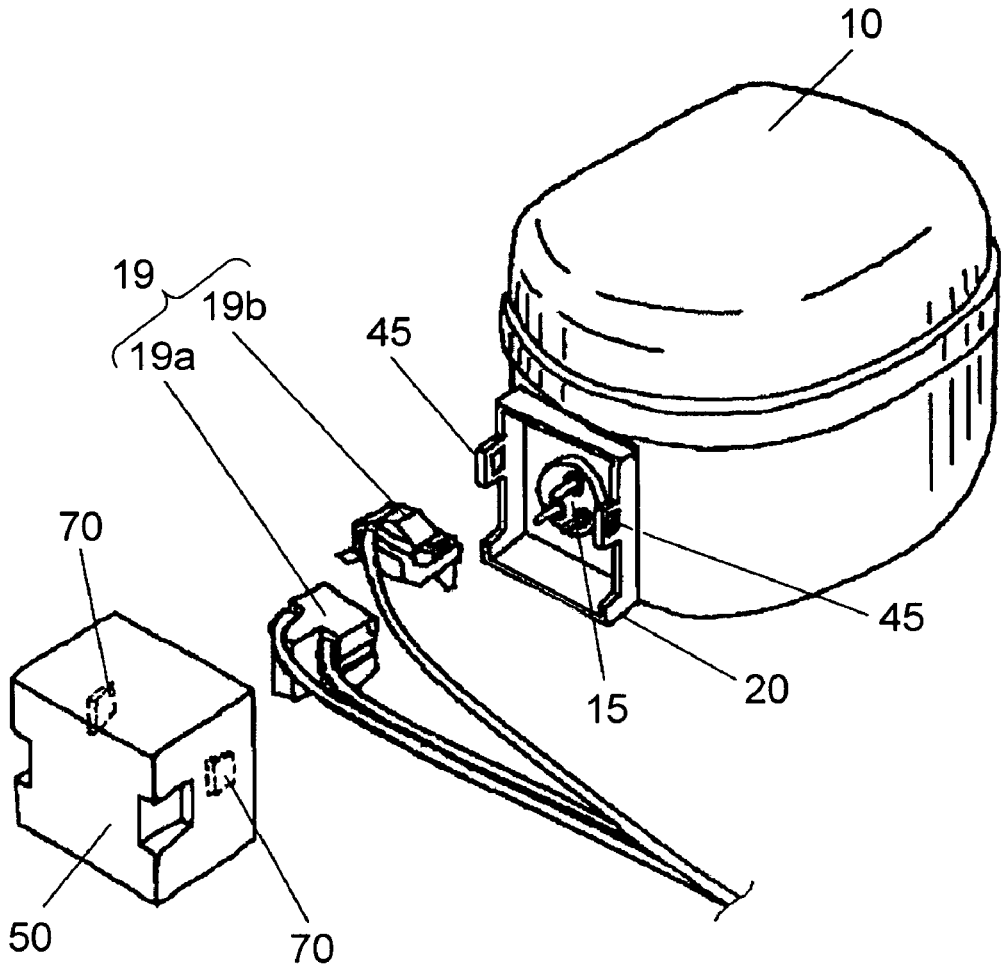
FIG. 7 PRIOR ART
FIG. 7 is an exploded perspective view of the conventional protecting device.
Figure 8:
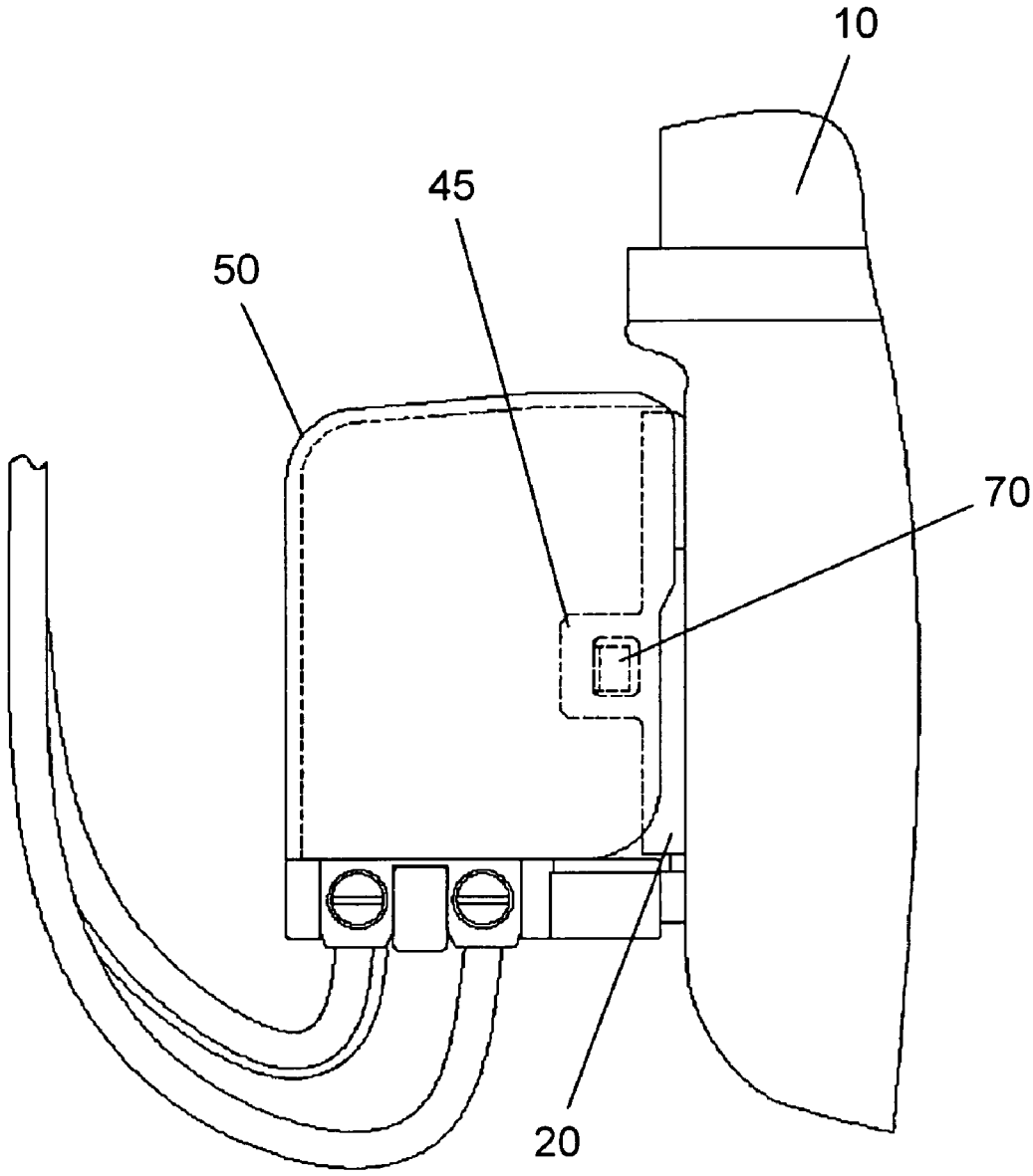
FIG. 8 PRIOR ART
FIG. 8 is an enlarged side view of the conventional protecting device, in a state of being mounted.

A description is made for an exemplary embodiment using FIGS. 1 through 6.

In FIGS. 1 through 6, electromotive compressor unit 110 containing its electromotive compressing element (not illustrated) is mounted thereon with glass terminal 115 for supplying the electromotive compressing element with electricity. Glass terminal 115 is connected with electric components 119*a* and 119*b* for protecting or starting the above-mentioned electromotive compressing element.

Bracket 120, made of a bend formed iron plate, such as a cold-rolled or hot-rolled steel plate, is fastened to electromotive compressor unit 110 so as to enclose glass terminal 115. Bracket 120 is attached thereon with cover 150 for covering electric components 119*a* and 119*b*.

Next, a description is made for further details about the protecting device. The topside of bracket 120 is bend formed thereon with insert portion 130, and the under side is bend formed thereon with locking part 140 at the opposite position across glass terminal 115. Insert portion 130 is composed of a pair of projections 135*a* with a long projected portion, and projection 135*b* with a short projected portion, formed between projections 135*a*. Projections 135*a* and 135*b* are all formed on the same plane. Each corner of distal end 137 of projection 135*a* is provided with chamfer 138, rounded or obtuse. Projection 135*b* includes distal end 137*b*. Locking part 140 is provided with locking hole 145, punch pressed.

The projected portion of locking part 140 is smaller than the large portion of projection 135*a*, and larger than the small portion of projection 135*b*. Locking part 140 is formed at the position opposite to projection 135*b* across glass terminal 115. Locking part 140 is formed smaller than projection 135*b* in width.

Cover 150 is formed by injection molding of synthetic resin material such as PP or PC. The positions corresponding to a pair of projections 135*a*, at the upper part of the inner wall surface of cover 150, are provided thereon with a pair of clamps 160*a*, substantially U-shaped. The position corresponding to projection 135*b*, between clamps 160*a*, is provided thereon with a clamp 160*b*, substantially U-shaped. Clamp 160 has a substantially U-shaped cross section so that projection 135 is inserted, and has a draft angle with its maximum clearance at the opening.

The height of the position corresponding to distal end 137 when projection 135 is inserted is assumed to be substantially identical to the thickness of projection 135. The opening of clamp 160 is chamfered. The position corresponding to locking hole 145, at the lower part of the inner wall surface, is formed thereon with a tapered ratchet for being locked in locking hole 145.

Hereinafter, a description is made for the operation of assembling the protecting device composed as described above. First, insert fix electric component 119*b* into glass terminal 115; insert electric component 119*a* into cover 150; and then cover 150 into bracket 120.

In this case, first, each of multiple substantially U-shaped clamps 160*a*, provided on cover 150, clamps each of multiple projections 135*a* with different length of projected portions in insert direction, provided on bracket 120. Clamp 160*a* continues to be inserted while horizontally moving to insert portion 130, and as a result that tapered ratchet 170 on cover 150 touches locking part 140 formed facing insert portion 130, the side wall provided thereon with ratchet 170 of cover 150 deforms outward from locking part 140. Then as a result that clamp 160*a* is further inserted, clamp 160*b* clamps projection 135*b*, resulting in tapered ratchet 170 fastened to locking hole 145 of bracket 120.

When fastened in this way, the clearance between distal end 137 and clamp 160 becomes minute at a position where distal end 137 of projection 135 and clamp 160 are clamped. Clamping at such a minute clearance occurs at different positions in insert direction on the flat surface of insert portion 130. Therefore, even if multiple substantially U-shaped clamps 160 have draft angle for injection molding, a clamped position at a minute clearance exists at each distal end 137 and clamp 160. That is to say, clamping is made at multiple different positions in insert direction, on the flat surface of insert portion 130. Consequently, an environment for a fit can be achieved where the entire flat surface of insert portion 130 is clamped with a minute clearance, thus suppressing looseness between cover 150 and bracket 120 with ratchet 170 as the supporting point.

Next, in order to detach cover 150 from bracket 120, only one ratchet 170 needs to be detached from locking hole 145. Ratchet 170 can be detached as a result that only the wall surface of cover 150 provided with ratchet 170 deforms, eliminating fracture caused by cover 150 largely deforming when being detached. This makeup further enables cover 150 to be securely fixed without looseness, and provides favorable workability in attaching and detaching.

In this exemplary embodiment, insert portion 130 of bracket 120 is provided on the topside of bracket 120, thus uniformly covering the entire flat surface of insert portion 130 with cover 150. Consequently, this makeup prevents water ingress into cover 150 when water flows down from an upper part of cover 150.

In this exemplary embodiment, the distal end of projection 135*a* with the longest projected portion projects from the distal end of locking part 140. Consequently, when inserting cover 150 into bracket 120, if only projection 135 with the longest projected portion is inserted into clamp 160*a*, remaining projection 135 and locking part 140 are automatically inserted in decreasing order of the length of projected portions. This results in easy and proper installation work when inserting cover 150 into bracket 120.

In this exemplary embodiment, the corner at distal end 137*a* of projection 135*a* with the longest projected portion is provided with chamfer 138. Chamfer 138 thus tapers distal end 137*a* and works as a guide in an insertion process, resulting in easy positioning for inserting projection 135*a* into clamp 160*a* when inserting cover 150 into bracket 120, and further improving workability for installation.

In this exemplary embodiment, projection 135*b* with a short projected portion is arranged oppositely to locking part 140, and projection 135*b* is larger than locking part 140 in width. Such a makeup enables projection 135*b* with a short projected portion to be laid out combined with locking part 140 for production material when bracket 120 is developed as a planer shape shown in FIG. 6. Consequently, when forming bracket 120 using a progressive die, for example, the production cost can be reduced, as wasted material is reduced.

As described hereinbefore, it has been conventionally assumed that at least two fixing parts are necessary in order to fix the cover without looseness. Therefore, the cover has been fixed with two ratchets. Meanwhile, the cover according to the present invention has a makeup in which the cover is positioned to a position other than the ratchet, and a part of the cover clamps the bracket in order to stably fix the cover. Further, one ratchet, which is the minimum, is provided so that the cover is not easily detached. Consequently, the present invention provides a protecting device favorable in workability for attaching and detaching the cover, resistant to fracture, and highly reliable.

INDUSTRIAL APPLICABILITY

A protecting device according to the present invention can be applied to a protecting device of any compressor such as a refrigerator, air conditioner, or fridge-freezer apparatus.

The invention claimed is:

1. A device for protecting an electric component comprising:

a bracket fixed to a compressor unit, the bracket having a fixing portion, an insert portion and a locking part having a locking hole; and a cover made of resin having a clamp into which a distal end of the insert portion is inserted and a ratchet that is fastened to the locking hole, wherein the insert portion including the distal end and the locking part protrude from the fixing portion in the same direction.

2. The device for protecting an electric component as claimed in claim 1, wherein the insert portion is provided on an upper side of the bracket.

3. The device for protecting an electric component as claimed in claim 1, wherein the insertion portion has a plurality of projections, a distal end of a projection with a longest projected portion of the projections projects beyond a distal end of the locking part.

4. The device for protecting an electric component as claimed in claim 1, wherein the insertion portion has a plurality of projections, the distal end of the projection is chamfered.

5. The device for protecting an electric component as claimed in claim 1, wherein the insertion portion has a plurality of projections, a projection with a short projected portion of the projections is arranged oppositely to the locking part, and the projection is to be longer than the locking part in width.

* * * * *

UNITED STATES PATENT AND TRADEMARK OFFICE

CERTIFICATE OF CORRECTION

PATENT NO. : 7,387,519 B2
APPLICATION NO. : 10/591874
DATED : June 17, 2008
INVENTOR(S) : Junichi Sugiyama It is certified that error appears in the above-identified patent and that said Letters Patent is hereby corrected as shown below:

On the Title Page

Item (86): PCT No. "PCT/JP2006/002784" should read -- PCT/JP2006/302784 --.

Signed and Sealed this

Eighteenth Day of November, 2008

JON W. DUDAS
*Director of the United States Patent and Trademark Office*